United States Patent [19]

Shindo

[11] Patent Number: 4,854,480

[45] Date of Patent: Aug. 8, 1989

[54] LONG RANGE TRIGGER-ACTUATED SQUIRT GUN

[76] Inventor: Robert S. Shindo, 4862 Grant St., Omaha, Nebr. 68104

[21] Appl. No.: 140,711

[22] Filed: Jan. 4, 1988

[51] Int. Cl.[4] ..... A63H 3/18; B65D 37/00

[52] U.S. Cl. ..... 222/79; 222/183; 222/210; 222/212; 141/26; 446/473; 446/475

[58] Field of Search ..... 222/79, 183, 105, 175, 222/210, 212; 446/473, 475; 141/2, 18, 21, 25, 26

[56] References Cited

U.S. PATENT DOCUMENTS

| | | | |
|---|---|---|---|
| 600,552 | 3/1898 | Parker . | |
| 617,495 | 1/1899 | Reimann . | |
| 688,882 | 12/1901 | Parker . | |
| 1,629,019 | 5/1927 | Cohn . | |
| 2,751,116 | 6/1956 | O'Brian | 222/79 |
| 2,802,298 | 8/1957 | Larin | 46/8 |
| 3,005,495 | 10/1961 | Herberg | 169/31 |
| 3,189,232 | 6/1965 | Joffe | 222/394 |
| 3,486,539 | 12/1969 | Jacuzzi | 222/189 X |
| 3,848,808 | 11/1974 | Fetty et al. | 222/183 X |
| 4,135,559 | 1/1979 | Barnby | 446/475 X |
| 4,214,674 | 7/1980 | Jones et al. | 222/79 |
| 4,257,460 | 3/1981 | Paranay et al. | 446/473 X |
| 4,735,239 | 4/1988 | Salmon et al. | 446/473 X |

OTHER PUBLICATIONS

1987 Laramie Corp. Catalog, pp. 6–7.
Unidentified Toy Gun Catalog, pp. 11, 12, & 15.

*Primary Examiner*—Kevin P. Shaver
*Attorney, Agent, or Firm*—John A. Beehner

[57] ABSTRACT

A squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

7 Claims, 2 Drawing Sheets

LONG RANGE TRIGGER-ACTUATED SQUIRT GUN

TECHNICAL FIELD

This invention relates generally to squirt guns, and more particularly to squirt guns that are capable of placing liquid under pressure and thence dispensing the liquid at a high velocity to a great distance.

BACKGROUND OF THE INVENTION

Squirt guns have long been known in the prior art. Such squirt guns usually include a hollow housing fashioned in the shape of a rifle or pistol, the housing adapted to hold water or other liquid. A trigger on the housing is typically connected to a pump built into the housing, movement of the trigger causing a small amount of water to be forced outwardly through a nozzle in the barrel. However, squirt guns which utilize a pump-type trigger suffer from the drawback that the pressure which ejects the water from the squirt gun is limited to that which can be attained by a single stroke or pull on the trigger. Thus, the shooting range of the pump type squirt gun is quite limited. Further, such pump action type squirt guns lack realism.

Newer developments in the squirt gun art utilize compressed gas to assist in forcing greater quantities of liquid out from the squirt gun to greater distances. One method of injecting compressed gas into the hollow housing of the gun is in the use of a removable cartridge of compressed gas. Other versions of compressed-air type squirt guns utilize manually actuated hand pumps which will introduce air into the housing and compress the air by pumping action. While both such squirt guns have a longer range, the pressure maintained in the housing must be replenished by pumping or the use of an additional cartridge of compressed gas. Furthermore, the use of compressed gas requires at least some space within the hollow housing into which the gas may be compressed so as to force the water out of the nozzle. This limits the amount of liquid which may be inserted in the squirt gun.

Squirt guns with electrically powered pumps are also known. However, such devices require batteries, or another power source, which must be frequently replaced.

Problems common to all pump-type squirt guns reside in their use of complicated pump mechanisms with many parts. Not only are such mechanisms expensive, but they are also prone to breakage during use.

It is therefore a principle object of the present invention to provide an improved trigger-actuated squirt gun capable of propelling liquid a long distance.

Another object of the present invention is to provide an improved squirt gun which does not require the use of compressed gas or pump mechanisms.

A further object of the present invention is to provide a long range trigger-actuated squirt gun with very few moving parts.

Still another object is to provide a squirt gun which is simple in operation, economical to manufacture, durable in use and refined in appearance.

These and other objects will be apparent to those skilled in the art.

SUMMARY OF THE INVENTION

The long range trigger-actuated squirt gun of the present invention includes a hollow housing in the form of a gun. A liquid dispensing assembly within the housing has an elastomeric rubber tube portion which is expandable upon being filled with liquid. The rubber tube is connected to a rigid tube with a nozzle at one end, and will dispense liquid from the rubber tube through the nozzle. A pivotable trigger is mounted with one end in squeezable engagement with a bearing in the spirit gun housing. The rubber tube extends between the bearing and trigger so that pulling the trigger releases the squeezable engagement, to thereby allow liquid to flow through the rubber tube and be propelled out the nozzle. A rigid coil around the rubber tube between the trigger and rigid tube restrains the rubber tube from expansion for the length of the coil. An adapter is provided which is threadable on a faucet, for filling the rubber tube with water. A small aperture in the adapter corresponds with the nozzle of the squirt gun to allow filling.

DESCRIPTION OF THE PREFERRED EMBODIMENT

Figure 1:
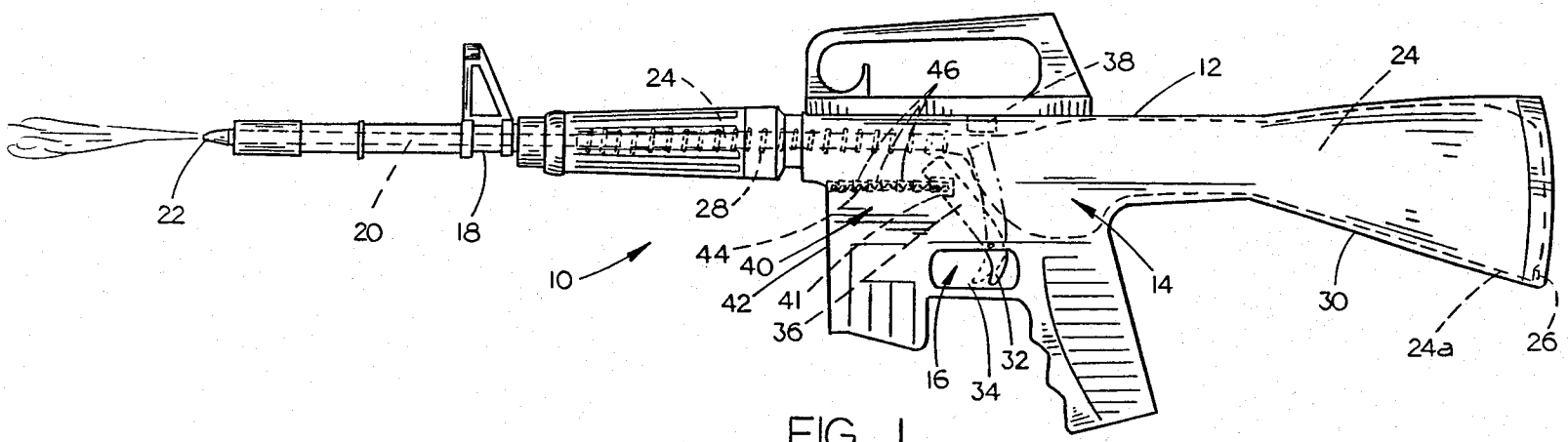
FIG. 1 is a side elevational view of the squirt gun of this invention, the housing in the form of a rifle.

Referring now to the drawings, in which similar or corresponding parts are identified with the same reference numeral, the squirt gun of this invention is designated generally at 10, and includes a hollow housing 12, a water dispensing assembly 14, and an operable trigger 16.

The embodiment of FIG. 1 shows housing 12 having an appearance similar to that of an M-16 rifle. The shape of the housing may take on many appearances, such as that shown in FIGS. 3 and 4, wherein squirt gun 10' is shaped to appear like an UZI-style weapon.

Housing 12 is hollow and has a barrel portion 18. Water dispensing assembly 14 is mounted within housing 12, and includes a rigid tube portion 20 having a nozzle 22 at one end, and an elongated rubber tube 24 connected to the other end. Rubber tube 24 is a highly resilient and elastomeric material which is expandable in width and length when filled with fluid. A plug 26 in the free end 24a of rubber tube 24 will cause liquid within rubber tube 24 to be maintained therein (as shown in FIG. 1).

A coil 28 has an inner diameter slightly greater than the outer diameter of rubber tube 24, such that tube 24 may be inserted through coil 28 as shown in FIG. 1. Coil 28 acts as a collar to restrain rubber tube 24 from expanding while within the length of coil 28.

As is best shown in FIG. 1, liquid dispensing assembly 14 is mounted within housing 12 with rigid tube 20 located in barrel 18 and nozzle 22 projecting from the end thereof. Rubber tube 24 extends rearwardly within housing 12 from rigid tube 20, with free end 24a located within the stock portion 30 of housing 12.

Trigger 16 is pivotally mounted to housing 12 with one end 32 projecting from the housing into a finger opening 34, so as to be freely actuatable by the user. The other end 36 of trigger 16 projects upwardly into housing 12 closely adjacent a depending bearing 38. Pivotal movement of trigger 16 will move end 36 within housing 12 so as to squeeze rubber tube 24 between bearing 38 and upper end 36, thereby preventing the escape of liquid from rubber tube portion 24 outwardly through nozzle 22.

Upper end 36 of trigger 16 is based into an "off" position, wherein liquid cannot escape from rubber tube 24, by a telescoping rod member 40 connected between end 36 and a forward wall 41 of housing 12. A compression spring 44 within a series of telescoping cup portions 46 from the telescoping rod member 40, and project into a slot 41 in upper end 36 of trigger 16 so as to slidably bear against pivotal movement of trigger 16.

Figure 2:
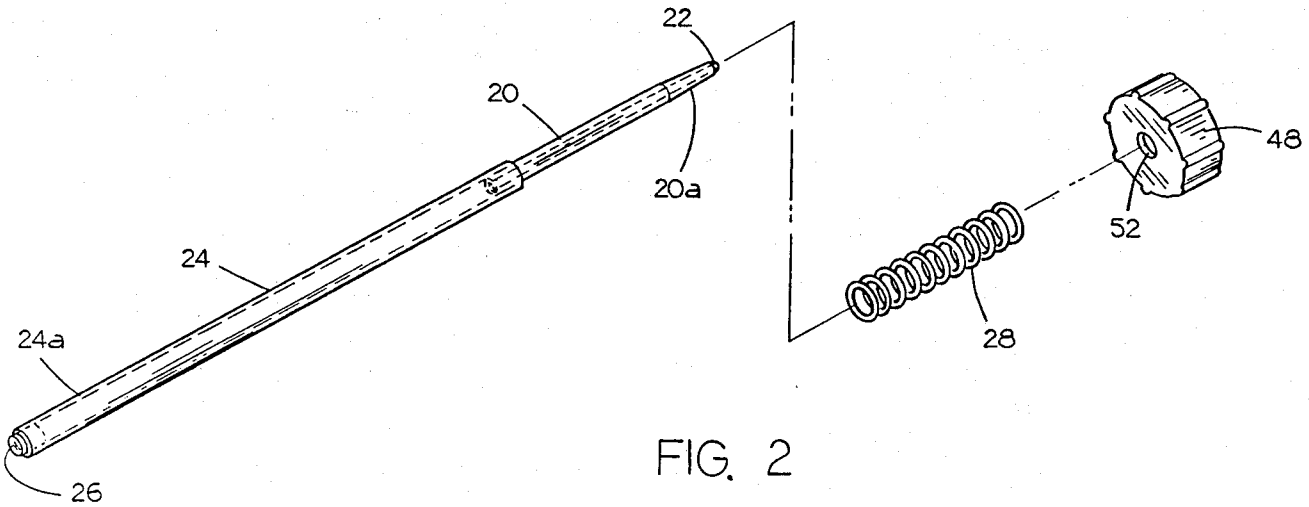
FIG. 2 is an exploded perspective view of the liquid dispensing assembly of the invention, and a faucet adaptor.
Figure 3:
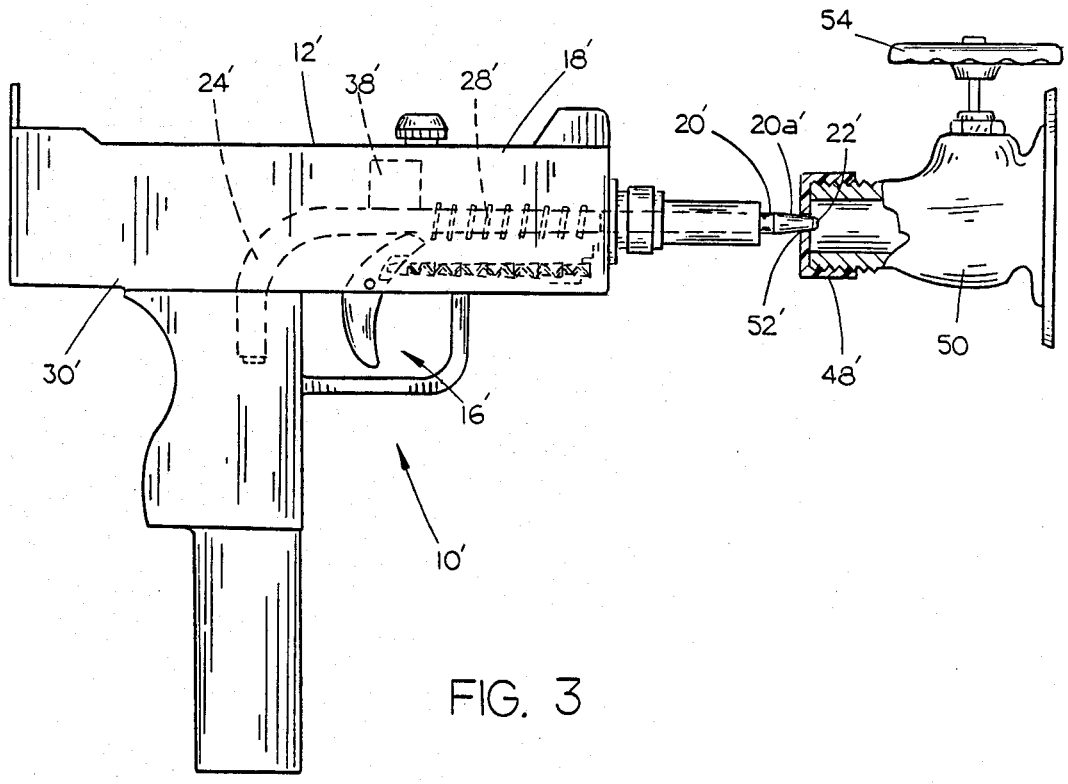
FIG. 3 is a side elevational view of another embodiment of the invention positioned against a faucet for filling.

In order to "load" the squirt gun 10 an interiorly-threaded adaptor 48 (see FIG. 2) is threaded onto a conventional exteriorly-threaded faucet 50 (see FIG. 3). A small aperture 52 (FIG. 2) corresponds with a tapered portion 20*a* at the nozzle-end of tube 20. Nozzle 22 is inserted through aperture 52 in adaptor 48 with tapered portion 20*a* forming a tight seal therewith. Trigger 16 is then actuated by pivoting end 32, thereby pivoting end 36 against the bias of telescoping rod member 40. This movement pivots end 36 out of the "off" position where it squeezed rubber tube 24 against bearing 38, and allows liquid to flow from nozzle 22 through tube 20 and into rubber tube 24. The pressure of the liquid expands rubber tube 24 within housing 12 and substantially fills the hollow portions. Once rubber tube 24 is full, trigger 16 is released and allowed to be biased into its squeezing contact with bearing 38. The squirt gun 10 is then ready for use, with the elasticity of rubber tube 24 supplying the force for propelling liquid from squirt gun 10, upon actuation.

Figure 4:
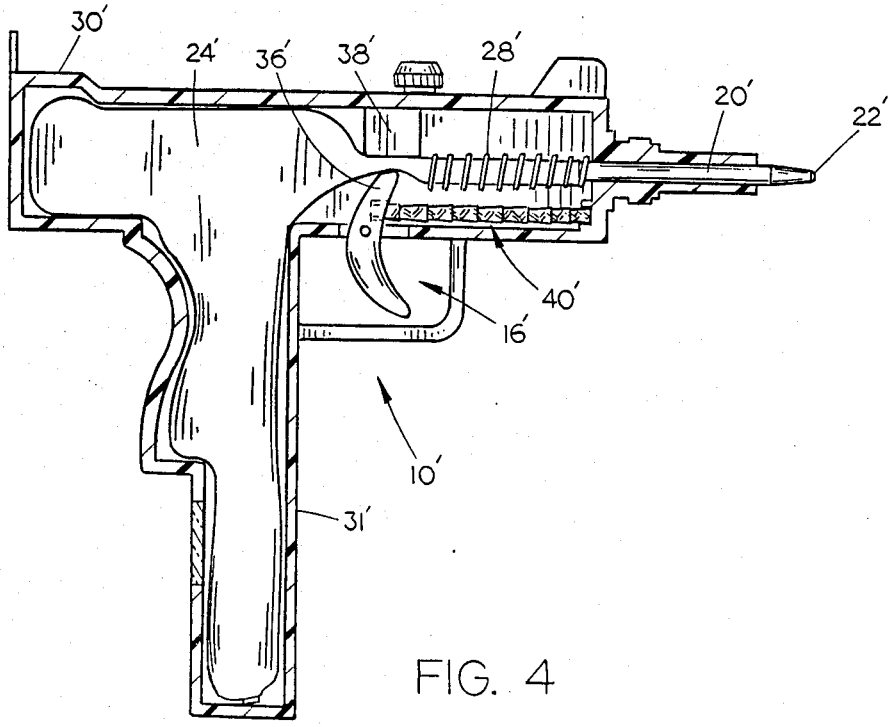
FIG. 4 is a side sectional view of the embodiment of FIG. 3 showing the liquid dispensing assembly of the invention filled with liquid.

Referring now to FIGS. 3 and 4, a second embodiment of the invention is designated generally at 10'. FIG. 3 shows squirt gun 10' positioned with nozzle 22' inserted through aperture 52' in adaptor 48'. Tapered portion 20*a'* of tube 20' is in sealed contact with adaptor 48'.

Coil 28' is mounted within housing 12' and extends from one end of barrel 18' rearwardly to a location adjacent bearing 38'. In FIG. 3, trigger 16' is shown in its actuated position, pivoted out of squeezing engagement with bearing 38'. Rubber tube 24' is shown prior to "loading" or filling with liquid. Handle 54 on faucet 50 may now be actuated so as to force water under pressure through nozzle 22' into rubber tube 24'. As shown in FIG. 4, rubber tube 24' will be expanded under the pressure of the liquid to substantially fill the entire stock portion 30' and handle portion 31' of squirt gun 10'. Coil 28' maintains the portion of rubber tube 24' forwardly of trigger 16' in its original nonexpanded condition. Without coil 28', liquid could build up forwardly of the trigger and be dispensed without regard to the position of trigger 16'.

In operation, actuation of trigger 16' against the bias of telescoping rod 40' will disengage end 36' from squeezing engagement with bearing 38', to thereby allow the elastomeric characteristics of rubber tube 24' to propel liquid from nozzle 22'.

It is preferred that rubber tube 24' have elastic characteristics which will cause water to be dispensed at a high velocity. The wall thickness of the rubber tube 24' will depend upon the size, density, and material of the tube, but is preferred to be within the range of 1/32 of an inch to 1/16 of an inch. In any case, the material of the rubber tube should be of a type such that conventional water pressure within a faucet 50 is sufficient to expand the rubber tube.

It can be seen that the squirt gun of this invention will cause a stream of liquid to be propelled at a high velocity to a great distance, while utilizing very few moving pieces and requiring no separate power supply. The squirt gun will always be capable of dispensing liquid by actuating the trigger without requiring the use to pump up pressure as in prior art squirt guns, and without requiring the use of a compressed air cartridge or electric pump.

It can therefore be seen the instant invention accomplishes at least all of the above-stated objectives.

I claim:

1. A squirt gun, comprising:

a substantially housing having a hollow interior and a passageway communicating from said hollow interior to the exterior of the squirt gun;

said housing and hollow interior having an irregular shape of a gun having a barrel arranged forwardly of and generally parallel to a stock portion and a handle portion extending downwardly from said stock portion, said passageway being located in said gun barrel;

an expandable elastomeric tube having an open end and a closed end, mounted within said housing, said tube being expandable from a normally collapsed tubular condition to an expanded condition substantially filling the irregularly shaped interior of said housing and expanding into the handle portion, the open end of said tube being mounted within said passageway for communication with the exterior of said aquirt gun; and an operable trigger mounted on said housing and adapted for exterior actuation, said trigger having means for selectively restraining the flow of fluid from within said expandable tube.

2. The squirt gun of claim 1, further comprising a rigid tube located within said passageway and communicating between said expandable tube and the exterior of said squirt gun.

3. The squirt gun of claim 1, further comprising a nozzle means associated with said passageway for increasing the velocity of fluid passing therethrough.

4. The squirt gun of claim 4, further comprising a collar means surrounding said expandable tube between said trigger and the open end of said expandable tube, said collar means preventing expansion of said expandable tube therewithin.

5. The squirt gun of claim 1, wherein said trigger is pivotally mounted with a lower end projecting exteriorly of said housing and an upper end projecting within the interior of said hollow housing, said upper end pivoting between an off position squeezing said expandable tube against the housing to restrain the flow of fluid therethrough, and an actuated position pivoted away from said expandable tube to allow fluid to flow therethrough.

6. The squirt gun of claim 5, further comprising means for biasing said trigger towards the off position, such that said trigger may be selectively actuated and will then return to its off position under the bias of said biasing means.

7. A long range trigger-actuated squirt gun, comprising:

a substantially hollow housing formed in the shape of a gun having a hollow interior and a barrel portion, a stock portion, and a handle portion;

a rigid tube mounted within said barrel portion and fluidly communicating between the hollow interior of the housing and the exterior of the squirt gun;

an expandable, elastomeric, normally collapsed tube having an open end and a closed end, the open end of said tube being fluidly connected to one end of said rigid tube, said expandable tube being expandable from a normally collapsed condition to an expanded condition substantially filling said stock portion of said housing and expanding into said handle portion;

a trigger operably mounted to said housing with a lower end projecting exteriorly adjacent said handle portion, and an upper end located so as to pivot between an actuated position adjacent said expandable tube and an off position with said upper end squeezing said expandable tube against said housing to restrain fluid flow therethrough; and means for biasing said trigger towards its off position.

* * * * *